US006076237A

United States Patent [19]

Goorhouse

[11] Patent Number: 6,076,237

[45] Date of Patent: Jun. 20, 2000

[54] QUICK-RELEASE BUCKLE FOR CONNECTING TWO STRAP ENDS

[76] Inventor: Donald E. Goorhouse, P.O. Box 214065, South Daytona, Fla. 32121

[21] Appl. No.: 09/327,649

[22] Filed: Jun. 8, 1999

[51] Int. Cl.[7] ..... A44B 11/00

[52] U.S. Cl. ..... 24/200; 24/614; 24/616; 24/615

[58] Field of Search ..... 24/200, 198, 614, 24/615, 616, 625, 606, 308, 573.1

[56] References Cited

U.S. PATENT DOCUMENTS

| | | | |
|---|---|---|---|
| 1,460,756 | 7/1923 | Humphrey . | |
| 1,793,836 | 2/1931 | Burns . | |
| 4,150,464 | 4/1979 | Tracy | 24/77 |
| 4,559,679 | 12/1985 | Downey | 24/615 |
| 4,688,337 | 8/1987 | Dillner et al. | 24/616 |
| 5,243,741 | 9/1993 | Fudaki et al. | 24/200 |
| 5,263,234 | 11/1993 | Fudaki | 24/615 X |
| 5,309,610 | 5/1994 | le Gal | 24/625 |
| 5,380,238 | 1/1995 | Crew-Gee | 24/573.1 X |
| 5,659,931 | 8/1997 | Anscher | 24/614 |
| 5,709,014 | 1/1998 | Takahashi | 24/614 |

*Primary Examiner*—Jame R. Brittain
*Assistant Examiner*—Robert J. Sandy
*Attorney, Agent, or Firm*—Warren F. B. Lindsley; Frank J. McGue

[57] ABSTRACT

A quick disconnect buckle made of a strong and flexible plastic such as poly carbonate, the buckle intended for personal or industrial use, with a high degree of strength relative to buckle dimensions achieved through the incorporation of a latch that employs a single large latching plate and mating opening that cover approximately half the face of the buckle.

7 Claims, 2 Drawing Sheets

QUICK-RELEASE BUCKLE FOR CONNECTING TWO STRAP ENDS

BACKGROUND OF THE INVENTION

Quick-release buckles are widely known for use in a large number of personal and industrial applications ranging from a means for securing the straps of a bicycle helmet to tying down the load on a truck. Successive innovations in the designs of quick-release buckles have produced improved functionality and reliability but there remains room for further improvements in terms of reduced bulk and weight without sacrifice in holding strength or reliability. The present invention is directed toward the achievement of such improvements in a physical configuration that is particularly simple in form and thus lends itself to inexpensive production in a wide range of dimensions and holding strengths.

DESCRIPTION OF THE PRIOR ART

Prior art devices which most closely relate to the quick-release buckle of the present invention are as follows:

U.S. Pat. No. 1,460,756 discloses a buckle comprising two sheet metal members, one of which has a hook that engages a transverse slot in the other member. Means are provided for the connection of a fixed strap to one member and for the connection of an adjustable strap to the other member.

U.S. Pat. No. 1,793,836 discloses a pair of metal members, one of which has a hook that is directed longitudinally and which engages a slot in the other member. Each member has a rectangular opening to which a strap may be fixedly connected (by sewing). This device has little or no protection against inadvertent disconnection.

U.S. Pat. No. 4,150,464 discloses a quick-release buckle comprising a first member defined as a receptacle and a second member defined as a clasp. The clasp member includes a pair of resilient arms having locking tabs thereon for releasably engaging the locking slots of the receptacle member. The receptacle member also includes a pair of grooves for slidably engaging cooperating raised ridges formed on a central arm of the clasp member for guiding the clasp member during insertion and removal from the receptacle member. Means are provided for a fixed belt connection to the clasp member and for an adjustable belt connection to the receptacle member. This device may be fabricated for the most part from plastics, but it is undesirably complex in its physical configuration and it is therefor likely to be larger and heavier than one might wish for many applications.

U.S. Pat. No. 4,559,679 discloses a quick-release buckle comprising interlocking metal fingers housed in a plastic shell. Elastic fingers integral with the plastic shell and disposed at opposite edges thereof are pinched to release the buckle. Strap connections are made at the ends of the device, one of which may be adjustable. This device is small and lightweight but it is too difficult to release for such applications as bicycle helmets.

U.S. Pat. No. 5,309,610 discloses a quick-release buckle for connecting together two straps including a fixed strap and an adjustable strap. The buckle comprises a male part and a female part. The male part has a forked configuration with a central guide finger and two symmetrical lateral elastic clipping fingers. The female part comprises a shell having a front opening formed by two respectively upper and lower plates, said shell having two lateral openings which interact with the ends of the elastic fingers. The upper plate of the shell extends beyond the front opening to cover the strap connection of the male member. This device is intended to be made from plastic parts, but again its physical configuration is undesirably complex.

SUMMARY OF THE INVENTION

In accordance with the invention claimed, an improved quick-release buckle is provided in a simple form that incorporates features essential to a wide range of applications.

It is, therefore, one object of the present invention to provide an improved quick-release buckle.

Another object of this invention is to provide such a quick-release buckle in a simple and inexpensive form.

A further object of this invention is to provide such a quick-release buckle in a form which provides a high degree of holding strength relative to its physical dimensions and weight.

A still further object of this invention is to provide such a quick-release buckle in a form that will not be inclined to open accidentally in the presence of vibration or shock.

A still further object of this invention is to provide such a quick-release buckle in a form that is easily fastened.

A still further object of this invention is to provide such a quick-release buckle in a form that is easily released.

A still further object of this invention is to provide such a quick-release buckle in a form that has no sharp corners in its open or its closed conditions.

A still further object of this invention is to provide such a quick-release buckle in a form that incorporates means for making one fixed and one adjustable belt connection.

A still further object of this invention is to provide such a quick-release buckle in a form that is pleasing to the eye.

Yet another object of this invention is to provide such a quick-release buckle in a form that is adaptable to a wide range of physical dimensions.

Other objects and advantages of the invention relating to details of construction and operation will be apparent from the following description and from the appended claims.

BRIEF DESCRIPTION OF THE DRAWINGS

The present invention may be more readily described by references to the accompanying drawings in which.

DESCRIPTION OF THE PREFERRED EMBODIMENT

Referring more particularly to the drawings by characters of reference, FIGS. 1–10 disclose an improved quick-release buckle 10 of the invention, buckle 10 comprising a female member in the form of a shell or receptacle 11, and a male member in the form of a plunger 12.

Figure 1:
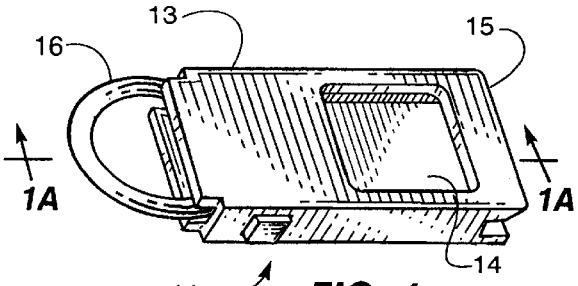
FIGS. 1 and 2 are perspective views of the female and male members of the buckle.
Figure 1A:
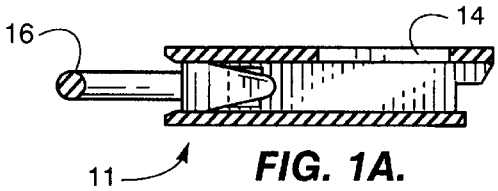
FIG. 1A is a cross-sectional view of FIG. 1 taken along line 1A—1A.

As shown most clearly in the perspective view of FIG. 1 and in the cross-sectional view of FIG. 1A, receptacle 11 comprises a hollow shell that is generally rectangular, its overall dimensions and proportions in a first implementation of the invention approximately those of the game piece known as a domino. Both ends of receptacle 11 are open and one of the major faces, here designated as the upper face 13, has a square or rectangular opening 14 covering nearly a half of the total area of face 13. Opening 14 is positioned near end 15 of the receptacle that receives plunger 12. A removable base 16 for making a fixed belt connection is attached at the opposite or forward end of shell 11.

Figure 2:
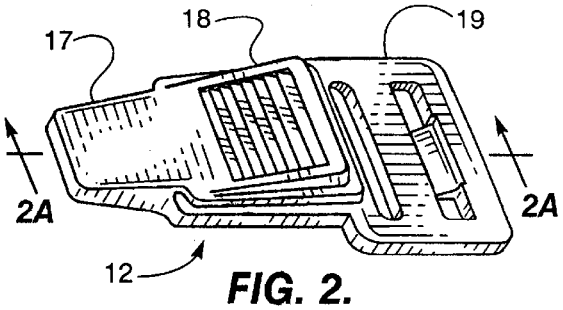
Figure 2A:
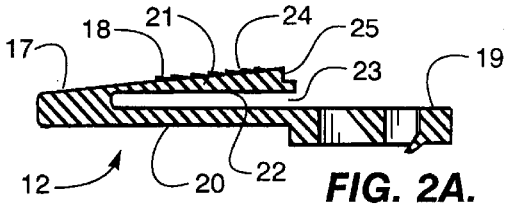
FIG. 2A is a cross-sectional view of FIG. 2 taken along line 2A—2A.

As shown most clearly in the perspective view of FIG. 2 and in the cross-sectional view of FIG. 2A, plunger 12 comprises three sections including a tapered nose 17, a rectangular latch section 18 and a base 19 for making an adjustable belt connection.

The rectangular latch section 18 comprises a lower plate 20 and a wedge-shaped upper plate 21. Lower plate 20, which extends longitudinally forward from base 18, supports the tapered nose 17, while nose 17 supports upper plate 21 which extends rearwardly therefrom.

As shown in FIG. 2A, in its unstressed condition (prior to the insertion of plunger 12 into shell 11), upper plate 21 has its lower surface 22 extending rearwardly from nose 17 in parallel alignment with lower plate 20 leaving a flex space 23 between lower surface 22 and lower plate 20. By virtue of its wedge-shaped cross-section, however, the upper surface 24 of upper plate 21 slopes upwardly from its forward point of connection at nose 17 to its rearward edge 25.

Plunger 12 and receptacle 11 including base 16 are molded from a strong plastic such as poly-carbonate. This material provides the necessary strength and the degree of flexibility required for this device.

Figure 3:
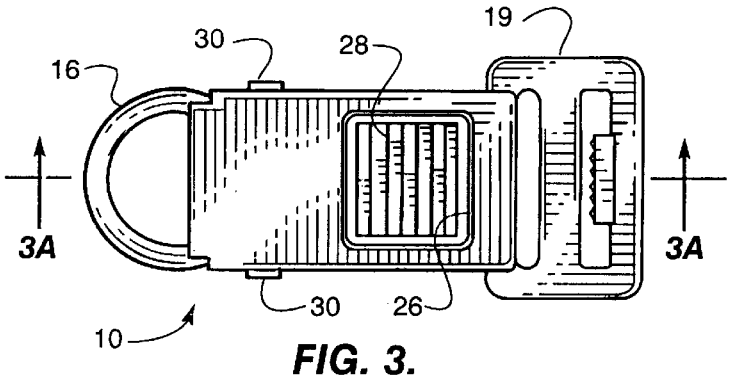
FIG. 3 is a front view of the first embodiment showing the member of FIG. 1 installed in the member of FIG. 2 in the latched condition.
Figure 3A:
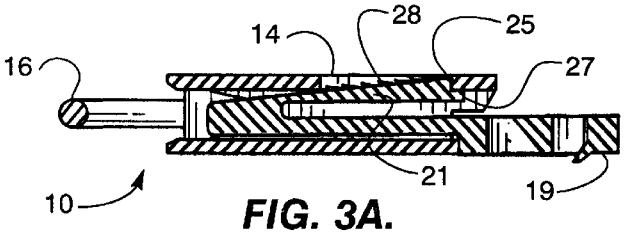
FIG. 3A is a cross-sectional view of FIG. 3 taken along line 3A—3A.

The latched condition of buckle 10, as shown in FIGS. 3 and 3A, is obtained by inserting plunger 12, tapered nose 17 first, into the open end of receptacle 11 opposite base 16. As the wedge-shaped upper plate 21 enters the interior of receptacle 11, plate 21 is compressed and deflects downwardly until sufficient clearance is obtained for entry. Entry continues until the rearward edge 25 of plate 21 becomes aligned with the rearward edge 26 of opening 14 of receptacle 11 at which point the rearward portion of wedge-shaped plate 21 recoils and snaps into the locked position shown in FIGS. 3 and 3A. A retainer ridge 27 projecting rearwardly from the lower rearward edge of plate 21 limits entry of plate 21 into opening 14 so that at its highest point of entry, the upper surface of plate 21 does not project above the top surface of face 13 of receptacle 11. The degree of taper for wedge-shaped plate 21 is designed to insure that the entry deformation of plate 21 is not completely relieved in the locked condition of the buckle so that plate 21 continues to be urged upwardly to the limit position set by ridge 27. This insures a reliably locked condition for buckle 10.

To release the buckle from the locked condition, plate 21 is depressed, preferably by the thumb of the user, while pulling the attached belts apart or by pushing the plate in the unlatching direction using the same thumb that depresses the plate. The top surface of plate 21 has transverse ridges 28 to mark the pressure point for releasing the buckle; the ridges also provide traction for manipulation by the thumb.

Figure 4:
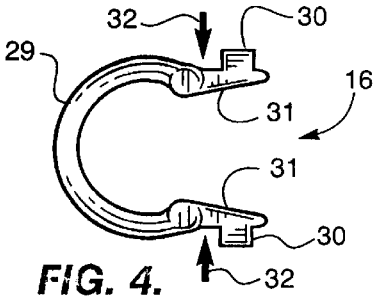
FIG. 4 is a plan view of a component of the female member of FIG. 1 that serves as an attachment means for a fixed belt or strap.
Figure 5:
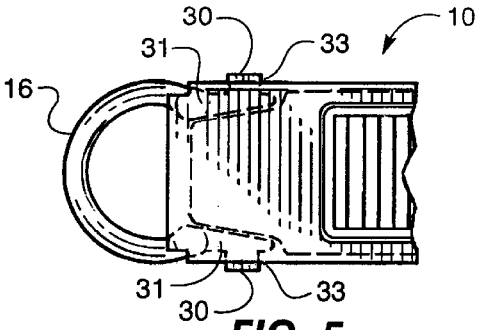
FIG. 5 is a dash line view of one end of FIG. 3 illustrating the means by which the belt attachment means of FIG. 4 is secured to the female member of the quick-release buckle of the invention.

The removable base 16 and its means of attachment are shown most clearly in FIGS. 3, 4, and 5. As shown, the external part 29 of base 16 to which the belt is to be secured is semicircular. Attachment to the end of the receptacle is achieved by means of ears 30 that project outwardly from tangential extensions 31 at the ends of the semicircular part 29. The base is installed in the end of the receptacle 11 by first compressing the open ends of the base toward each other as indicated by the arrows 32 in FIG. 4, inserting the extensions and ears into the end of shell 11, aligning the ears with apertures 33 in the sides of the shell and letting the ears snap into place as shown in FIG. 5. Note that the tapered end 17 of plunger 12 extends into the space between the extensions 31. Like the other components of buckle 10, base 16 is molded from a poly-carbonate material for strength and flexibility.

Figure 6:
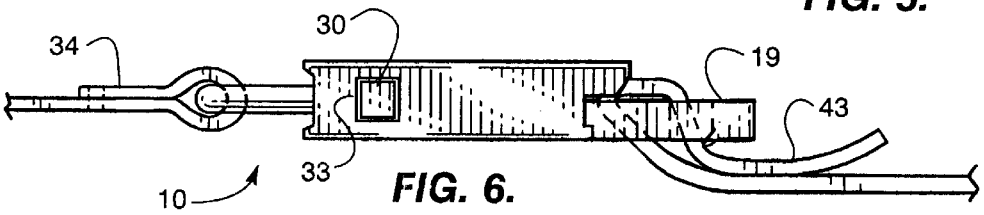
FIG. 6 is an edge view showing the quick-release buckle of FIGS. 1–5 in its latched condition with belts or straps attached at both ends.
Figure 7:
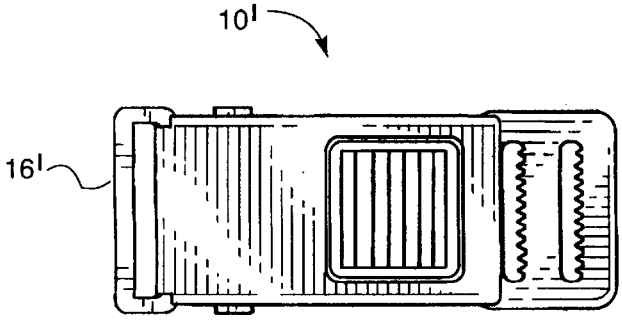
FIG. 7 is a plan or face view of a second embodiment of the invention.
Figure 8:
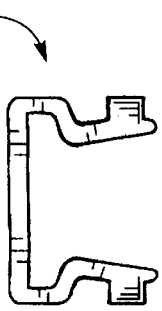
FIG. 8 is a plan view of an attachment means incorporated in the quick-release buckle of FIG. 7.

A fixed belt connection to base 16 as shown in FIG. 6 is made by first removing base 16 from receptacle 11. This can be done by depressing one of the ears, using a pointed object as a tool, while withdrawing base 16 from receptacle or shell 11. A leg of the base is then inserted into the loop of belt 34, the loop having been formed at the end of the belt by folding over the end and sewing it to belt 34. The base with the belt attached is then installed as described earlier.

The semicircular shape facilitates installation of heavy, bulky belts that are difficult to maneuver into narrow slots. For smaller, less bulky belts the modified base 16', i.e. configuration 16' of FIGS. 7 and 8 may be preferred.

Figure 9:
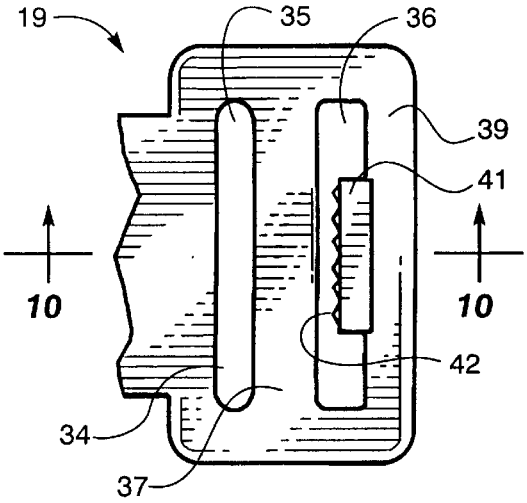
FIG. 9 is an enlarged view of an adjustable attachment means employed in the quick-release buckle of FIGS. 1–5, integral with the male member of FIG. 2, this means serving as an adjustable attachment means.
Figure 10:
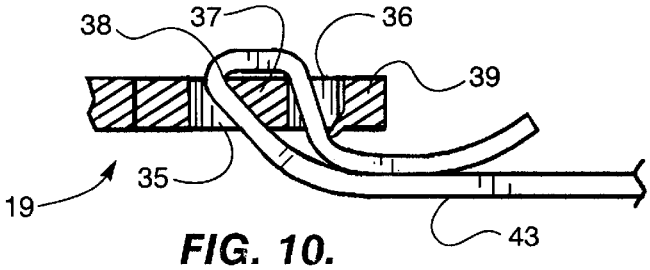
FIG. 10 is a cross-sectional view of FIG. 9 taken along line 10—10, showing the manner in which a belt or strap has been installed.

The preferred form of base 19 for making an adjustable belt connection is shown more clearly in FIG. 6 and in the enlarged views of FIGS. 9 and 10.

As indicated earlier, base 19 is integral with plunger 12, extending rearwardly from rectangular latch section 18. Base 19 has the general form of a belt buckle with two transverse slots including a forward or inboard slot 35 and a rearward or outboard slot 36, the two slots defining a central bar 37.

As shown in FIG. 10, the central bar has a generally triangular cross-section with a sharp corner 38 formed along its upper forward edge.

The rearward bar 39 of base 19 which encloses slot 35 has a centrally located projection 41 that extends in a forward and downward direction from the lower forward corner 41 of bar 39. Projection 41 has a sharp leading edge that is equipped with a series of projecting points 42 evenly distributed along its length.

As indicated in FIG. 10, when the adjustable belt 43 is installed in the conventional manner (passing first through the forward or inboard slot 35 from beneath base 19 and returning via the rearward or outboard slot), any tension applied to belt 43 urges the belt against the sharp corner 38 of bar 37 and against the projecting points 42 of bar 39 causing these sharp projections to bite into the belt to positively resist its movement.

It was found that for a number of belt types, the length of projection 41 should equal approximately one third the length of slot 35 for maximum holding strength. For other belt types, it may be desirable to extend the projection 41 to cover the full length of slot 35.

Figure 11:
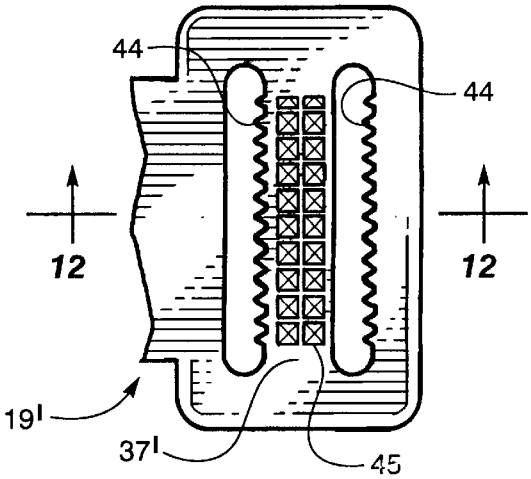
FIG. 11 is a plan view showing a second embodiment of the adjustable belt attachment means of FIG. 9 and FIG. 10.
Figure 12:
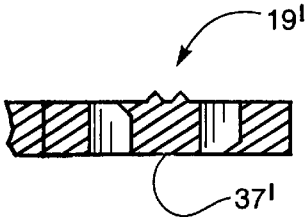
FIG. 12 is a cross-sectional view of FIG. 11 taken along line 12—12.

Alternatively, the configuration 19' of FIGS. 11 and 12 might be preferable with its saw-tooth edges 44 along the forward upper edge of central bar 37' and along the lower forward edge of rearward bar 39' and two additional rows of projecting points 45 provided along the top surface of central bar 37'.

A simple and inexpensive quick-release buckle is thus provided in accordance with the stated objects of the invention. In contrast to the relatively fragile latching means located at the narrow edges of prior art devices the present invention provides a latching plate that extends across the full width of the buckle. This design feature provides the desired high degree of holding strength relative to the physical dimensions of the device. The unrelaxed strain residing in this same wide plate solidly secures the latched condition through conditions of vibration and shock. The buckle of the present invention is easily latched and easily released, it has no sharp corners that could constitute a hazard in an accident, and the design is adaptable over a wide range of dimensions and holding strengths.

Although but a few embodiments of the invention have been illustrated and described, it will be apparent to those skilled in the art that various changes and modifications may be made therein without departing from the spirit of the invention or from the scope of the appended claims.

What is claimed is:

1. A quick-release buckle for connecting together two belt ends, said buckle comprising:

a flat hollow elongated female member having two openings at each end thereof, one of said openings adapted to receive a plunger and a first belt connecting means at the other opening thereof, said first connecting means comprising a base having an open end, the open end of the base having two ears which are adapted to be inserted into the other opening and detachably connected to two corresponding apertures positioned on opposite sides of said female member, said female member having a rectangular opening positioned near the opening adapted to receive the plunger, a flat elongated male member forming the plunger having a tapered nose and a wedge shaped plate extending upwardly and rearwardly from said nose, said wedge shaped plate resiliently compressing when said plunger is inserted into the opening adapted to receive the plunger, said wedge shaped upper plate recoiling to engage the rectangular opening for interlocking said male member with said female member, said male member forming a second belt connecting means at an other end thereof adapted to receive one of two belt ends, said second connecting means comprising a flat plate having at least one slot extending laterally of a longitudinal axis of said plunger adapted to receive the other of said two belt ends, and a plurality of teeth formed along at least a part of a periphery of said at least one slot for grasping and holding said other of said two belt ends when said other of said two belt ends is inserted therein.

2. The quick-release buckle set forth in claim 1 wherein:

said second connecting means comprises two slots extending laterally of the longitudinal axis of said plunger and substantially parallel with each other.

3. The quick-release buckle set forth in claim 1 wherein:

said at least one slot extends perpendicular of said plunger.

4. The quick-release buckle set forth in claim 1 wherein:

said second connecting means comprises a plurality of teeth formed along a raised surface of the periphery of said at least one slot for grasping and holding the other of said two belt ends when the other belt end is inserted therethrough.

5. The quick-release buckle set forth in claim 1 wherein:

said first connecting means comprises an arcuate configuration.

6. The quick-release buckle set forth in claim 1 wherein:

the at least one slot of said second connecting means being formed in a parallel arrangement with the one slot of said at least one slots furthest from said plunger being provided with said teeth.

7. A quick release buckle for connecting together two belt ends, said buckle comprising:

a flat hollow elongated female member having two openings at each end thereof, one of said openings adapted to receive a plunger and a first belt connecting means at the other opening thereof, said first connecting means comprising a base having an open end, the open end of the base having two ears which are adapted to be inserted into the other opening and detachably connected to two corresponding apertures positioned on opposite sides of said female member, said female member having a rectangular opening positioned near the opening adapted to receive the plunger, a flat elongated male member forming the plunger having a tapered nose and a wedge shaped plate extending upwardly and rearwardly from said nose, said wedge shaped plate resiliently compressing when said plunger is inserted into the opening adapted to receive the plunger, said wedge shaped upper plate recoiling to engage the rectangular opening for interlocking said male member with said female member, said male member forming a belt connecting means at an other end thereof adapted to receive one of two belt ends, said connecting means comprising a flat plate having at least one slot extending laterally of a longitudinal axis of said plunger for receiving the other of said two belt ends, and a plurality of saw teeth formed along at least a part of the edge of said at least one slot for grasping and holding said other of said two belt ends, another of said openings of said female member adapted to receive a semi-arcuate detachable connecting means.

* * * * *